US007475831B2

(12) United States Patent
Van Steenkiste et al.

(10) Patent No.: US 7,475,831 B2
(45) Date of Patent: Jan. 13, 2009

(54) MODIFIED HIGH EFFICIENCY KINETIC SPRAY NOZZLE

(75) Inventors: Thomas Hubert Van Steenkiste, Ray, MI (US); Taeyoung Han, Bloomfield Hills, MI (US); Bryan A. Gillispie, Warren, MI (US)

(73) Assignee: Delphi Technologies, Inc., Troy, MI (US)

( * ) Notice: Subject to any disclaimer, the term of this patent is extended or adjusted under 35 U.S.C. 154(b) by 719 days.

(21) Appl. No.: 10/763,824

(22) Filed: Jan. 23, 2004

(65) Prior Publication Data

US 2005/0161532 A1 Jul. 28, 2005

(51) Int. Cl.
*B05B 1/24* (2006.01)

(52) U.S. Cl. ..... 239/13; 239/8; 239/79; 239/85; 239/135; 239/433; 239/589; 118/308; 427/180

(58) Field of Classification Search ..... 239/1, 239/8, 13, 79, 85, 128, 135, 433, 434, 589; 118/308; 427/180, 189, 190, 191, 192, 195; 451/102

See application file for complete search history.

(56) References Cited

U.S. PATENT DOCUMENTS

| | | | | |
|---|---|---|---|---|
| 2,861,900 | A | 11/1958 | Smith et al. | |
| 3,100,724 | A | 8/1963 | Rocheville | |
| 3,876,456 | A | 4/1975 | Ford et al. | |
| 3,993,411 | A | 11/1976 | Babcock et al. | |
| 3,996,398 | A | 12/1976 | Manfredi | |
| 4,263,335 | A | 4/1981 | Wagner et al. | |
| 4,300,723 | A * | 11/1981 | Prasthofer | 239/589 |
| 4,416,421 | A | 11/1983 | Browning et al. | |
| 4,603,810 | A * | 8/1986 | Schleimer et al. | 239/589 |
| 4,606,495 | A | 8/1986 | Stewart, Jr. et al. | |
| 4,891,275 | A | 1/1990 | Knoll | |
| 4,939,022 | A | 7/1990 | Palanisamy | |
| 5,187,021 | A | 2/1993 | Vydra et al. | |
| 5,217,746 | A | 6/1993 | Lenling et al. | |
| 5,271,965 | A | 12/1993 | Browning | |
| 5,302,414 | A | 4/1994 | Alknimor et al. | |
| 5,308,463 | A | 5/1994 | Hoffmann et al. | |

(Continued)

FOREIGN PATENT DOCUMENTS

| | | |
|---|---|---|
| DE | 42 36 911 | 12/1993 |

(Continued)

OTHER PUBLICATIONS

Dykhuizen, et al.; *Gas Dynamic Principles of Cold Spray*; Journal of Thermal Spray Technology; Jun. 1998; pp. 205-212.

(Continued)

*Primary Examiner*—Steven J Ganey
(74) *Attorney, Agent, or Firm*—Thomas W. Twomey

(57) ABSTRACT

A modified high efficiency kinetic spray nozzle is disclosed. The modified nozzle has a rapid expansion rate in the diverging region relative to prior art nozzles, which enables one to achieve much higher particle velocities without an increase in the main gas temperature. Preferably, the expansion rate of the supersonic nozzle in a portion of the diverging region is at least 1 $mm^2$ per millimeter, more preferably 2 $mm^2$ per millimeter, more preferably 5 $mm^2$ per mm, with a most preferable expansion rate being 10 $mm^2$ per millimeter.

14 Claims, 7 Drawing Sheets

U.S. PATENT DOCUMENTS 5,328,751 A 7/1994 Komorita et al.
5,330,798 A * 7/1994 Browning ..... 239/79
5,340,015 A 8/1994 Hira et al.
5,362,523 A 11/1994 Gorynin et al.
5,395,679 A 3/1995 Myers et al.
5,424,101 A 6/1995 Atkins et al.
5,464,146 A 11/1995 Zalvzec et al.
5,465,627 A 11/1995 Garshelis
5,476,725 A 12/1995 Papich et al.
5,493,921 A 2/1996 Alasafi
5,520,059 A 5/1996 Garshelis
5,525,570 A 6/1996 Chakraborty et al.
5,527,627 A 6/1996 Lautzenhiser et al.
5,585,574 A 12/1996 Sugihara et al.
5,593,740 A 1/1997 Strumbon et al.
5,648,123 A 7/1997 Kuhn et al.
5,683,615 A 11/1997 Munoz
5,706,572 A 1/1998 Garshelis
5,708,216 A 1/1998 Garshelis
5,725,023 A 3/1998 Padula
5,795,626 A 8/1998 Gabel et al.
5,854,966 A 12/1998 Kampe et al.
5,875,830 A 3/1999 Singer et al.
5,887,335 A 3/1999 Garshelis
5,889,215 A 3/1999 Kilmartin et al.
5,894,054 A 4/1999 Poruchuri et al.
5,907,105 A 5/1999 Pinkerton
5,907,761 A 5/1999 Tohma et al.
5,952,056 A 9/1999 Jordan et al.
5,965,193 A 10/1999 Ning et al.
5,989,310 A 11/1999 Chu et al.
5,993,565 A 11/1999 Pinkerton
6,033,622 A 3/2000 Maruyama
6,047,605 A 4/2000 Garshelis
6,051,045 A 4/2000 Narula et al.
6,051,277 A 4/2000 Claussen et al.
6,074,737 A 6/2000 Jordan et al.
6,098,741 A 8/2000 Gluf
6,119,667 A 9/2000 Boyer et al.
6,129,948 A 10/2000 Plummet et al.
6,139,913 A 10/2000 Van Steenkiste et al.
6,145,387 A 11/2000 Garshelis
6,149,736 A 11/2000 Sugihara
6,159,430 A 12/2000 Foster
6,189,663 B1 2/2001 Smith et al.
6,260,423 B1 7/2001 Garshelis
6,261,703 B1 7/2001 Sasaki et al.
6,283,386 B1 9/2001 Van Steenkiste et al.
6,283,859 B1 9/2001 Carlson et al.
6,289,748 B1 9/2001 Lin et al.
6,338,827 B1 1/2002 Nelson et al.
6,344,237 B1 2/2002 Kilmer et al.
6,374,664 B1 4/2002 Bauer
6,402,050 B1 6/2002 Kashirin et al.
6,422,360 B1 7/2002 Oliver et al.
6,424,896 B1 7/2002 Lin
6,442,039 B1 8/2002 Schreiber
6,446,857 B1 9/2002 Kent et al.
6,465,039 B1 10/2002 Pinkerton et al.
6,485,852 B1 11/2002 Miller et al.
6,488,115 B1 12/2002 Ozsoylu
6,490,934 B2 12/2002 Garshelis
6,511,135 B2 1/2003 Ballinger et al.
6,537,507 B2 3/2003 Nelson et al.
6,551,734 B1 4/2003 Simpkins et al.
6,553,847 B2 4/2003 Garshelis
6,615,488 B2 9/2003 Anders
6,623,704 B1 9/2003 Roth
6,623,796 B1 9/2003 VanSteenkiste et al.
6,624,113 B2 9/2003 LaBarge et al.
6,808,817 B2 * 10/2004 Morelli et al. ..... 427/376.2
6,972,138 B2 * 12/2005 Heinrich et al. ..... 239/85
7,143,967 B2 * 12/2006 Heinrich et al. ..... 427/192
2002/0071906 A1 6/2002 Rusch
2002/0073982 A1 6/2002 Shaikh et al.
2002/0102360 A1 8/2002 Subramanian et al.
2002/0110682 A1 8/2002 Brogan
2002/0112549 A1 8/2002 Cheshmehdoost et al.
2002/0182311 A1 12/2002 Leonardi et al.
2003/0039856 A1 2/2003 Gillispie et al.
2003/0190414 A1 10/2003 VanSteenkiste
2003/0219542 A1 11/2003 Ewasyshyn et al.
2003/0228414 A1 * 12/2003 Smith et al. ..... 427/180

FOREIGN PATENT DOCUMENTS

DE 199 59 515 6/2001
DE 100 37 212 1/2002
DE 101 26 100 12/2002
EP 1 160 348 12/2001
EP 1245854 A2 2/2002
JP 55031161 3/1980
JP 61249541 11/1986
JP 04180770 6/1992
JP 04243524 8/1992
WO 98/22639 5/1998
WO 02/52064 1/2002
WO 03009934 2/2003

OTHER PUBLICATIONS

McCune, et al; *An Exploration of the Cold Gas-Dynamic Spray Method for Several Materials Systems*.
Ibrahim, et al; Particulate Reinforced Metal Matrix Composites—A Review; *Journal of Materials Science 26*; pp. 1137-1156.
I.J. Garshelis, et al; *A Magnetoelastic Torque Transducer Utilizing a Ring Divided into Two Oppositely Polarized Circumferential Regions*; MMM 1995; Paper No. BB-08.
I.J. Garshelis, et al; *Development of a Non-Contact Torque Transducer for Electric Power Steering Systems*; SAE Paper No. 920707; 1992; pp. 173-182.
Boley, et al; *The Effects of Heat Treatment on the Magnetic Behavior of Ring—Type Magnetoelastic Torque Sensors*; Proceedings of Sicon '01; Nov. 2001.
J.E. Snyder, et al; *Low Coercivity Magnetostrictive Material with Giant Piezomagnetic d33*, Abstract Submitted for the Mar. 1999 Meeting of the American Physical Society.
McCune, et al; *An Exploration of the Cold Gas-Dynamic Spray Method . . .* ; Proc. Nat. Thermal Spray Conf. ASM Sep. 1995.
Pavel Ripka, et al; *Pulse Excitation of Micro-Fluxgate Sensors*, IEEE Transactions on Magnetics, vol. 37, No. 4, Jul. 2001, pp. 1998-2000.
Trifon M. Liakopoulos, et al; *Ultrahigh Resolution DC Magnetic Field Measurements Using Microfabricated Fluxgate Sensor Chips*, University of Cincinnati, Ohio, Center for Microelectronic Sensors and MEMS, Dept. of ECECS pp. 630-631.
Derac Son, *A New Type of Fluxgate Magnetometer Using Apparent Coercive Field Strength Measurement*, IEEE Transactions on Magnetics, vol. 25, No. 5, Sep. 1989, pp. 3420-3422.
O. Dezauri, et al; *Printed Circuit Board Integrated Fluxgate Sensor*, Elsevier Science S. A. (2000) Sensors and Actuators, pp. 200-203.
How, et al; *Generation of High-Order Harmonics in Insulator Magnetic Fluxgate Sensor Cores*, IEEE Transactions on Magnetics, vol. 37, No. 4, Jul. 2001, pp. 2448-2450.
Van Steenkiste, et al; *Kinetic Spray Coatings*; in Surface & Coatings Technology III; 1999; pp. 62-71.
Liu, et al; *Recent Development in the Fabrication of Metal Matrix-Particulate Composites Using Powder Metallurgy Techniques*; in Journal of Material Science 29; 1994; pp. 1999-2007; National University of Singapore, Japan.
Papyrin; *The Cold Gas-Dynamic Spraying Method a New Method for Coatings Deposition Promises a New Generation of Technologies*; Novosibirsk, Russia.
McCune, al; Characterization of Copper and Steel Coatings Made by the Cold Gas-Dynamic Spray Method; National Thermal Spray Conference.

Alkhimov, et al; A Method of "Cold" Gas-Dynamic Deposition; *Sov. Phys. Kokl. 36*(12; Dec. 1990; pp. 1047-1049.

Dykuizen, et al; *Impact of High Velocity Cold Spray Particles*; in Journal of Thermal Spray Technology 8(4); 1999; pp. 559-564.

Swartz, et al; Thermal Resistance At Interfaces; *Appl. Phys. Lett.*, vol. 51, No. 26,28; Dec. 1987; pp. 2201-2202.

Davis, et al; Thermal Conductivity of Metal-Matrix Composites; *J.Appl. Phys. 77* (10), May 15, 1995; pp. 4494-4960.

Stoner et al; *Measurements of the Kapitza Conductance between Diamond and Several Metals*; Physical Review Letters, vol. 68, No. 10; Mar. 9, 1992; pp. 1563-1566.

Stoner et al; *Kapitza conductance and heat flow between solids at temperatures from 50 to 300K*; Physical Review B, vol. 48, No. 22, Dec. 1, 1993—II; pp. 16374;16387.

Johnson et al; *Diamond/Al metal matrix composites formed by the pressureless metal infiltration process*; J. Mater, Res., vol. 8, No. 5, May 1993; pp. 11691173.

Rajan et al; *Reinforcement coatings and interfaces in Aluminium Metal Matrix Composites*; pp. 3491-3503.

*LEC Manufacturing and Engineering Capabilities*; Lanxide Electronic Components, Inc.

Dykhuizen et al; *Gas Dynamic Principles of Cold Spray*; Journal of Thermal Spray Technology; Jun. 1998; pp. 205-212.

McCune et al; *An Exploration of the Cold Gas-Dynamic Spray Method For Several Materials Systems*.

Ibrahim et al; Particulate Reinforced Metal Matrix Composites—A Review; *Journal of Matrials Science 26*; pp. 1137-1156.

European Search Report dated Jan. 29, 2004 and it's Annex.

Moreland, *Fluxgate Magnetometer*, Carl W. Moreland, 199-2000, pp. 1-9.

Ripka, et al; *Symmetrical Core Improves Micro-Fluxgate Sensors*; Sensors and Acutuators, Version 1, Aug. 25, 2000, pp. 1-9.

Hoton How, et al; *Development of High-Sensitivity Fluxgate Magnetometer Using Single-Crystal Yttrium Iron Garnet Thick Film as the Core Material*, ElectroMagnetic Applications, Inc.

Ripka, et al; *Microfluxgate Sensor with Closed Core*, submitted for Sensors and Actuators, Version 1, Jun. 17, 2000.

Henriksen, et al; *Digital Detection and Feedback Fluxgate Magnetometer*, Meas. Sci. Technol. 7(1996) pp. 897-903.

Cetek 930580 Compass Sensor, *Specifications*, Jun. 1997.

Geyger, *Basic Principles Characteristics and Applications*, Magnetic Amplifier Circuits, 1954, pp. 219-232.

* cited by examiner

PRIOR ART

MODIFIED HIGH EFFICIENCY KINETIC SPRAY NOZZLE

TECHNICAL FIELD

The present invention is directed toward a design for a supersonic nozzle, and more particularly, toward a nozzle for a kinetic spray system.

INCORPORATION BY REFERENCE

The present invention comprises an improvement to the kinetic spray process as generally described in U.S. Pat. Nos. 6,139,913, 6,283,386 and the articles by Van Steenkiste, et al. entitled "Kinetic Spray Coatings" published in Surface and Coatings Technology Volume III, Pages 62-72, Jan. 10, 1999, and "Aluminum coatings via kinetic spray with relatively large powder particles", published in Surface and Coatings Technology 154, pp. 237-252, 2002, all of which are herein incorporated by reference.

BACKGROUND OF THE INVENTION

A new technique for producing coatings on a wide variety of substrate surfaces by kinetic spray, or cold gas dynamic spray, was recently reported in two articles by T. H. Van Steenkiste et al. The first was entitled "Kinetic Spray Coatings", published in Surface and Coatings Technology, vol. 111, pages 62-71, Jan. 10, 1999 and the second was entitled "Aluminum coatings via kinetic spray with relatively large powder particles", published in Surface and Coatings Technology 154, pp. 237-252, 2002. The articles discuss producing continuous layer coatings having high adhesion, low oxide content and low thermal stress. The articles describe coatings being produced by entraining metal powders in an accelerated gas stream, through a converging-diverging de Laval type nozzle and projecting them against a target substrate. The particles are accelerated in the high velocity gas stream by the drag effect. The gas used can be any of a variety of gases including air, nitrogen or helium. It was found that the particles that formed the coating did not melt or thermally soften prior to impingement onto the substrate. It is theorized that the particles adhere to the substrate when their kinetic energy is converted to a sufficient level of thermal and mechanical deformation. Thus, it is believed that the particle velocity must exceed a critical velocity to permit it to adhere when it strikes the substrate. It was found that the deposition efficiency of a given particle mixture was increased as the main gas temperature was increased. Increasing the main gas temperature decreases its density and thus increases its velocity and increases its pressure. The velocity varies approximately as the square root of the main gas temperature. The actual mechanism of bonding of the particles to the substrate surface is not fully known at this time. The critical velocity is dependent on the material of the particle and of the substrate. Once an initial layer of particles has been formed on a substrate subsequent particles not only eliminate the voids between previous particles bound to the substrate by compaction, but also engage in particle to particle bonds. The bonding process is not due to melting of the particles in the main gas stream because the temperature of the particles is always below their melting temperature.

The above kinetic spray methods all relied on high pressure particle powder feeders. These powder feeders are very expensive and can cause erosion of the throat of the kinetic spray nozzle. In addition, high pressure systems are prone to clogging at the throat of the nozzle, which limits the main gas temperatures that can be used.

A recent improvement was disclosed in U.S. application Ser. No. 10/117,385, filed Apr. 5, 2002. In this improvement the particle powder is introduced through the side of the nozzle in the diverging section, which allows a low pressure powder feeder to be used. Low pressure powder feeders are very common, inexpensive and reliable. One problem encountered with both low pressure and high pressure nozzles is the inability of certain types of particles to achieve critical velocity even at higher main gas temperatures and pressures. Thus, it would be advantageous to design a supersonic nozzle allowing particles to achieve higher velocity with the same main gas temperature and pressure.

SUMMARY OF THE INVENTION

In one embodiment, the present invention is a supersonic kinetic spray nozzle comprising: a converging region and a diverging region separated by a throat; at least a portion of the diverging region adjacent the throat having a cross-sectional expansion rate of at least 1.0 millimeters squared per millimeter. This expansion rate varies linearly with the variation in the cross-sectional area of the throat. The rate of at least 1.0 millimeters squared per millimeter is favored for a throat cross-sectional area of 9.08 millimeters squared.

In another embodiment, the present invention is a kinetic spray system comprising: a supersonic nozzle having a converging region and a diverging region separated by a throat; at least a portion of the diverging region adjacent the throat having a cross-sectional expansion rate of at least 1.0 millimeters squared per millimeter; at least one powder injector connected to the nozzle with one of a low pressure or a high pressure powder feeder connected to said injector; and a high pressure source of a heated main gas connected to the nozzle.

In another embodiment, the present invention is a method of applying a material via a kinetic spray process comprising the steps of: providing particles of a material to be sprayed; providing a supersonic nozzle having a throat located between a converging region and a diverging region at least a portion of said diverging region adjacent said throat having a cross-sectional expansion rate of at least 1.0 millimeters squared per millimeter; directing a flow of a gas through the nozzle, the gas having a temperature insufficient to cause melting of the particles in the nozzle; and entraining the particles in the flow of the gas and accelerating the particles to a velocity sufficient to result in adherence of the particles on a substrate positioned opposite the nozzle.

BRIEF DESCRIPTION OF THE DRAWINGS

The present invention will now be described, by way of example, with reference to the accompanying drawings, in which like parts throughout the views have the same reference number.

DESCRIPTION OF THE PREFERRED EMBODIMENT

Figure 1:
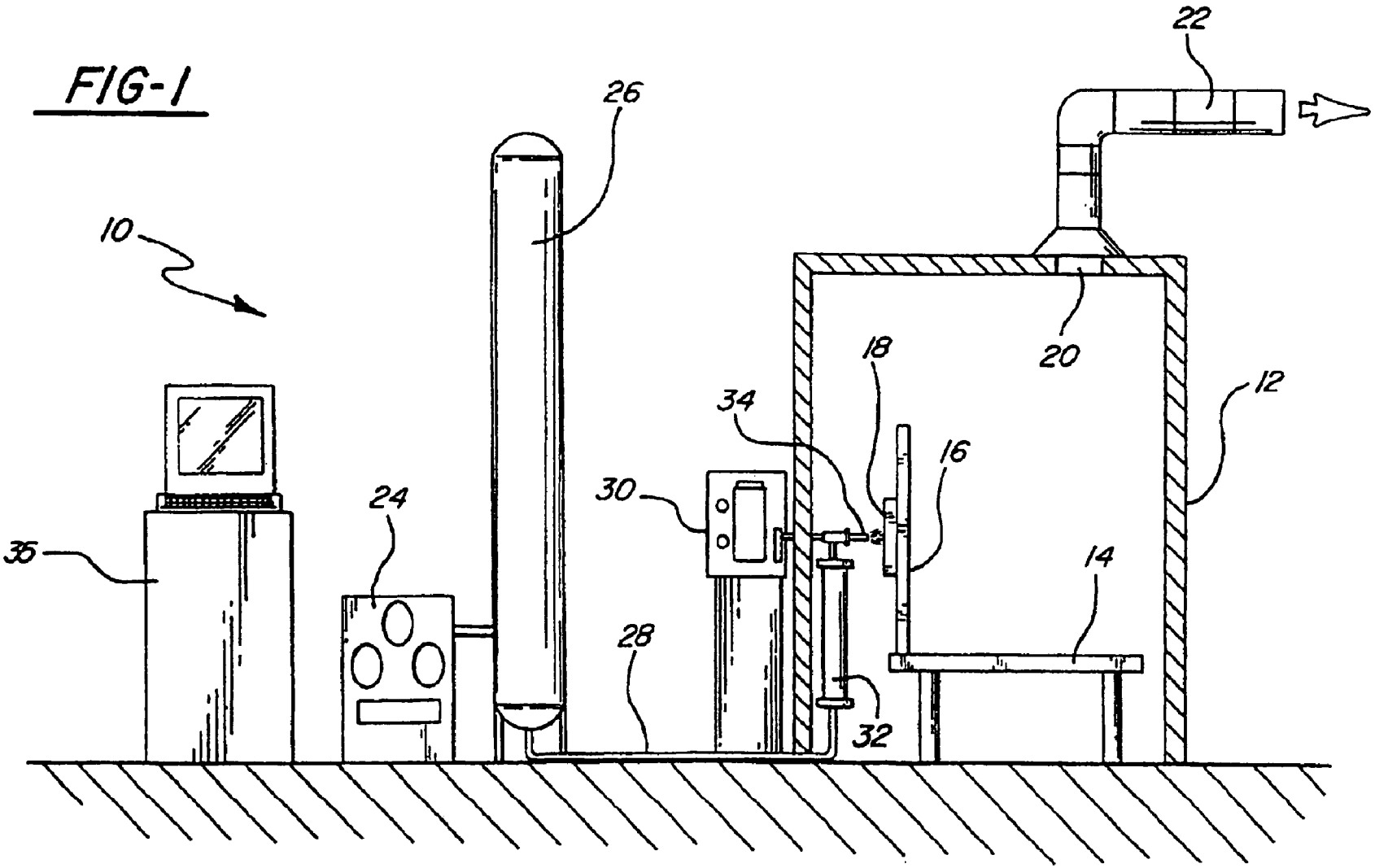
FIG. 1 is a general schematic layout illustrating a kinetic spray system for performing the method of the present invention.

Referring first to FIG. 1, a kinetic spray system according to the present invention is generally shown at 10. System 10 includes an enclosure 12 in which a support table 14 or other support means is located. A mounting panel 16 fixed to the table 14 supports a work holder 18 capable of movement in three dimensions and able to support a suitable workpiece formed of a substrate to be coated. The work holder 18 is preferably designed to move a substrate relative to a nozzle 34 of the system 10, thereby controlling where the powder material is deposited on the substrate. In other embodiments the work holder 18 is capable of feeding a substrate past the nozzle 34 at traverse rates of up to 50 inches per second. The enclosure 12 includes surrounding walls having at least one air inlet, not shown, and an air outlet 20 connected by a suitable exhaust conduit 22 to a dust collector, not shown. During coating operations, the dust collector continually draws air from the enclosure 12 and collects any dust or particles contained in the exhaust air for subsequent disposal.

The spray system 10 further includes an gas compressor 24 capable of supplying gas pressure up to 3.4 MPa (500 pounds per square inch) to a high pressure gas ballast tank 26. The gas ballast tank 26 is connected through a line 28 to both a powder feeder 30 and a separate gas heater 32. The gas heater 32 supplies high pressure heated gas, the main gas described below, to a kinetic spray nozzle 34. The pressure of the main gas generally is set at from 150 to 500 pounds per square inch (psi), more preferably from 300 to 400 psi. The powder feeder 30 is either a high pressure powder feeder or a low pressure powder feeder depending on the design of the nozzle 34 as described below. When the powder feeder 30 is a high pressure feeder 30 preferably the pressure is set at a pressure of from 25 to 100 psi above the main gas pressure, and more preferably from 25 to 50 psi above the pressure of the main gas. When the powder feeder 30 is a low pressure feeder the pressure is preferably from 10 to 200 psi total, more preferably from 10 to 100 psi total, even more preferably from 10 to 90 psi total, and most preferably from 10 to 60 psi. total. The powder feeder 30 mixes particles of a spray powder with the high or low pressure gas and supplies the mixture to a supplemental inlet line 48 of the nozzle 34. Preferably the particles are fed at a rate of from 20 to 1200 grams per minute, more preferably from 60 to 600 grams per minute to the nozzle 34. A computer control 35 operates to control the powder feeder 30, the pressure of gas supplied to the powder feeder 30, the pressure of gas supplied to the gas heater 32 and the temperature of the heated main gas exiting the gas heater 32.

The particles used in the present invention may comprise any of the materials disclosed in U.S. Pat. Nos. 6,139,913 and 6,283,386 in addition to other known particles. These particles generally comprise metals, alloys, ceramics, polymers, diamonds and mixtures of these. The particles preferably have an average nominal diameter of from 60 to 250 microns, more preferably from 60 to 200 microns, and most preferably from 60 to 150 microns. The substrate materials useful in the present invention may be comprised of any of a wide variety of materials including a metal, an alloy, a semi-conductor, a ceramic, a plastic, and mixtures of these materials. All of these substrates can be coated by the process of the present invention.

Depending on the particles or combination of particles chosen the main gas temperature may range from 600 to 1300 degrees Fahrenheit (° F.). The main gas has a temperature that is always insufficient to cause melting within the nozzle 34 of any particles being sprayed. For the present invention it is preferred that the main gas temperature range from 600 to 1300° F. depending on the material that is sprayed. What is necessary is that the temperature and exposure time of the particles to the main gas be selected such that the particles do not melt in the nozzle 34. The temperature of the gas rapidly falls as it travels through the nozzle 34. In fact, the temperature of the gas measured as it exits the nozzle 34 is often at or below room temperature even when its initial inlet temperature is above 1000° F.

Figure 2:
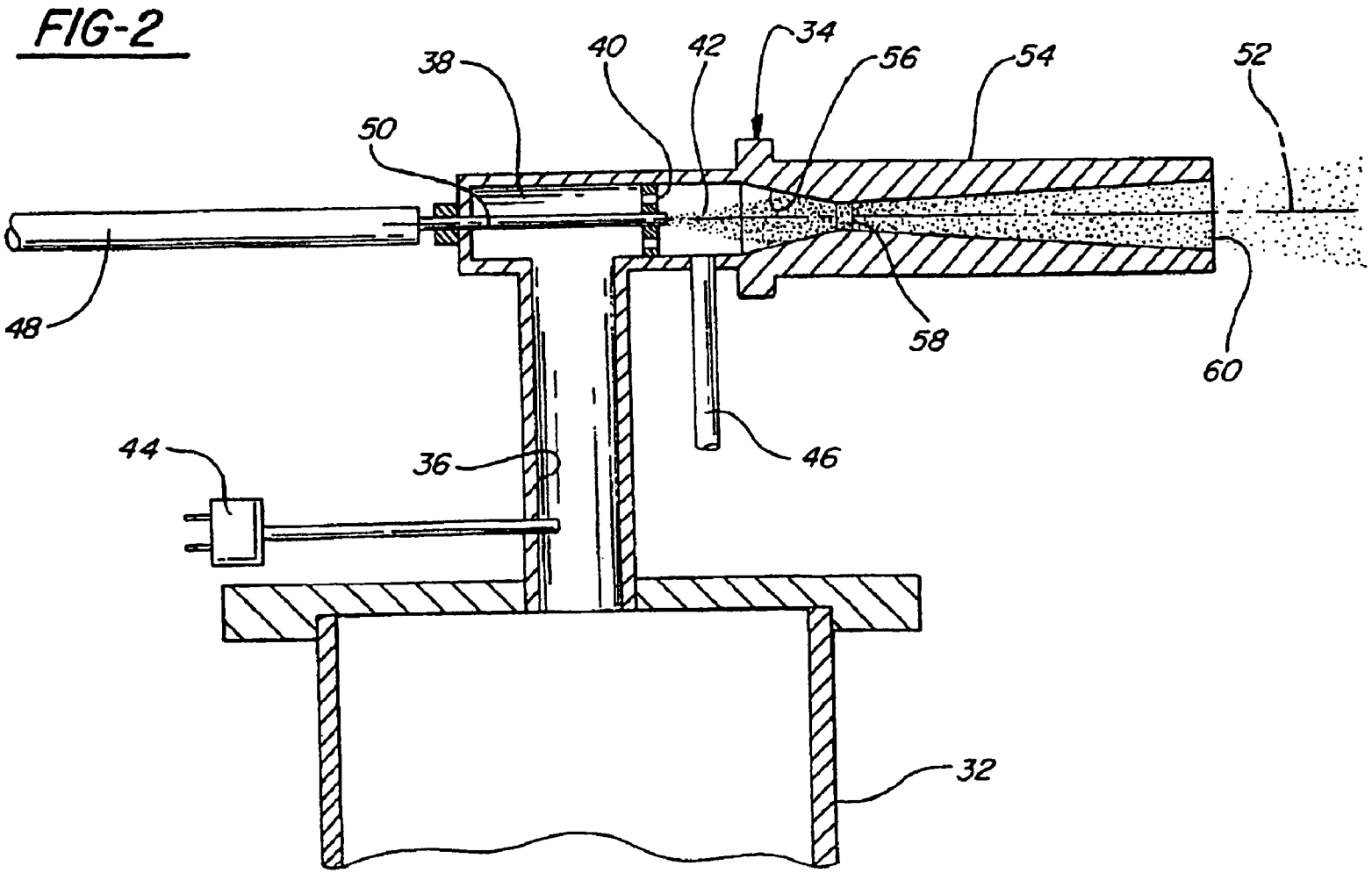
FIG. 2 is an enlarged cross-sectional view of a prior art kinetic spray nozzle used with a high pressure powder feeder in a kinetic spray system.

FIG. 2 is a cross-sectional view of a prior art nozzle 34 and its connections to the gas heater 32 and a high pressure powder feeder 30. This nozzle 34 has been used in a high pressure system. A main gas passage 36 connects the gas heater 32 to the nozzle 34. Passage 36 connects with a premix chamber 38 that directs gas through a gas collimator 40 and into a chamber 42. Temperature and pressure of the heated main gas are monitored by a gas inlet temperature thermocouple 44 in the passage 36 and a pressure sensor 46 connected to the chamber 42.

The mixture of high pressure gas and coating powder is fed through the supplemental inlet line 48 to the powder injector tube 50 comprising a straight pipe having a predetermined inner diameter. The tube 50 has a central axis 52 which is preferentially the same as the axis of the premix chamber 38. The tube 50 extends through the premix chamber 38 and the gas collimator 40 into the mixing chamber 42.

Chamber 42 is in communication with a de Laval type supersonic nozzle 54. The nozzle 54 has a central axis 52 and an entrance cone 56 that decreases in diameter to a throat 58. The entrance cone 56 forms a converging region of the nozzle 54. Downstream of the throat 58 is an exit end 60 and a diverging region is defined between the throat 58 and the exit end 60. The largest diameter of the entrance cone 56 may range from 10 to 6 millimeters, with 7.5 millimeters being preferred. The entrance cone 56 narrows to the throat 58. The throat 58 may have a diameter of from 5.5 to 1.5 millimeters, with from 4.5 to 2 millimeters being preferred. The diverging region of the nozzle 54 from downstream of the throat 58 to the exit end 60 may have a variety of shapes, but in a preferred embodiment it has a rectangular cross-sectional shape. At the exit end 60 the nozzle 54 preferably has a rectangular shape with a long dimension of from 8 to 14 millimeters by a short dimension of from 2 to 6 millimeters. In this prior art nozzle 54, the expansion rate of the interior cross-sectional area of the diverging region ranges from 0.1 $mm^2$/mm to 0.50 $mm^2$/mm.

As disclosed in U.S. Pat. Nos. 6,139,913 and 6,283,386 the powder injector tube 50 supplies a particle powder mixture to the system 10 under a pressure in excess of the pressure of the heated main gas from the passage 36. The nozzle 54 produces an exit velocity of the entrained particles of from 300 meters per second to as high as 1300 meters per second. The entrained particles gain kinetic and thermal energy during their flow through this nozzle 54. It will be recognized by those of skill in the art that the temperature of the particles in the gas stream will vary depending on the particle size and the main gas temperature. The main gas temperature is defined as the temperature of heated high-pressure gas at the inlet to the nozzle 54. Since the particles are never heated to their melting point, even upon impact, there is no change in the solid phase of the original particles due to transfer of kinetic and thermal energy, and therefore no change in their original physical properties. The particles are always at a temperature below the main gas temperature. The particles exiting the nozzle 54 are directed toward a surface of a substrate to be coated.

It is preferred that the exit end 60 of the nozzle 54 have a standoff distance from the surface to be coated of from 10 to 80 millimeters and most preferably from 10 to 20 millimeters. Upon striking a substrate opposite the nozzle 54 the particles flatten into a nub-like structure with an aspect ratio of generally about 5 to 1. Upon impact the kinetic sprayed particles stick to the substrate surface if their critical velocity has been exceeded. For a given particle to adhere to a substrate it is necessary that it reach or exceed its critical velocity which is defined as the velocity where at it will adhere to a substrate, because the kinetic energy of the particles must be converted to thermal and strain energies via plastic deformation upon impact. This critical velocity is dependent on the material composition of the particle and the type of substrate material. In general, harder materials must achieve a higher velocity before they adhere to a given substrate. The nature of the bonds between kinetically sprayed particles and the substrate is discussed in the article in *Surface and Coatings Technology* 154, pp. 237-252, 2002, discussed above.

Figure 3:
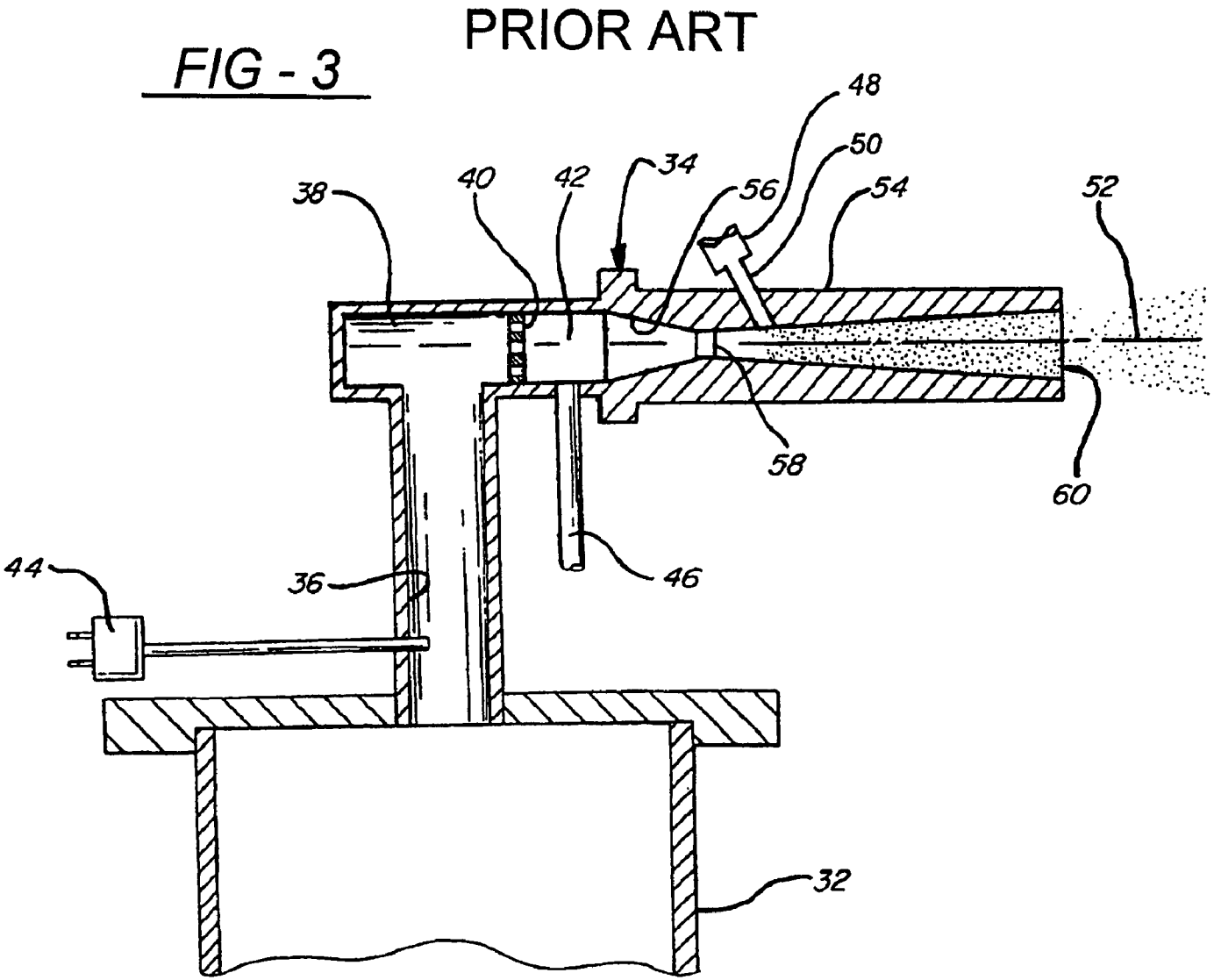
PRIOR ART FIG - 3
FIG. 3 is an enlarged cross-sectional view of a prior art kinetic spray nozzle used with a low pressure powder feeder in a kinetic spray system.

FIG. 3 is a cross sectional view of a prior art nozzle 34 for use with a low pressure powder feeder. The de Laval nozzle 54 is very similar to the high pressure one shown in FIG. 2 with the exception of the location of the supplemental inlet line 48 and the powder injector tube 50. In this prior art system the powder is injected after the throat 58, hence a low pressure feeder 30 can be used.

Figure 4:
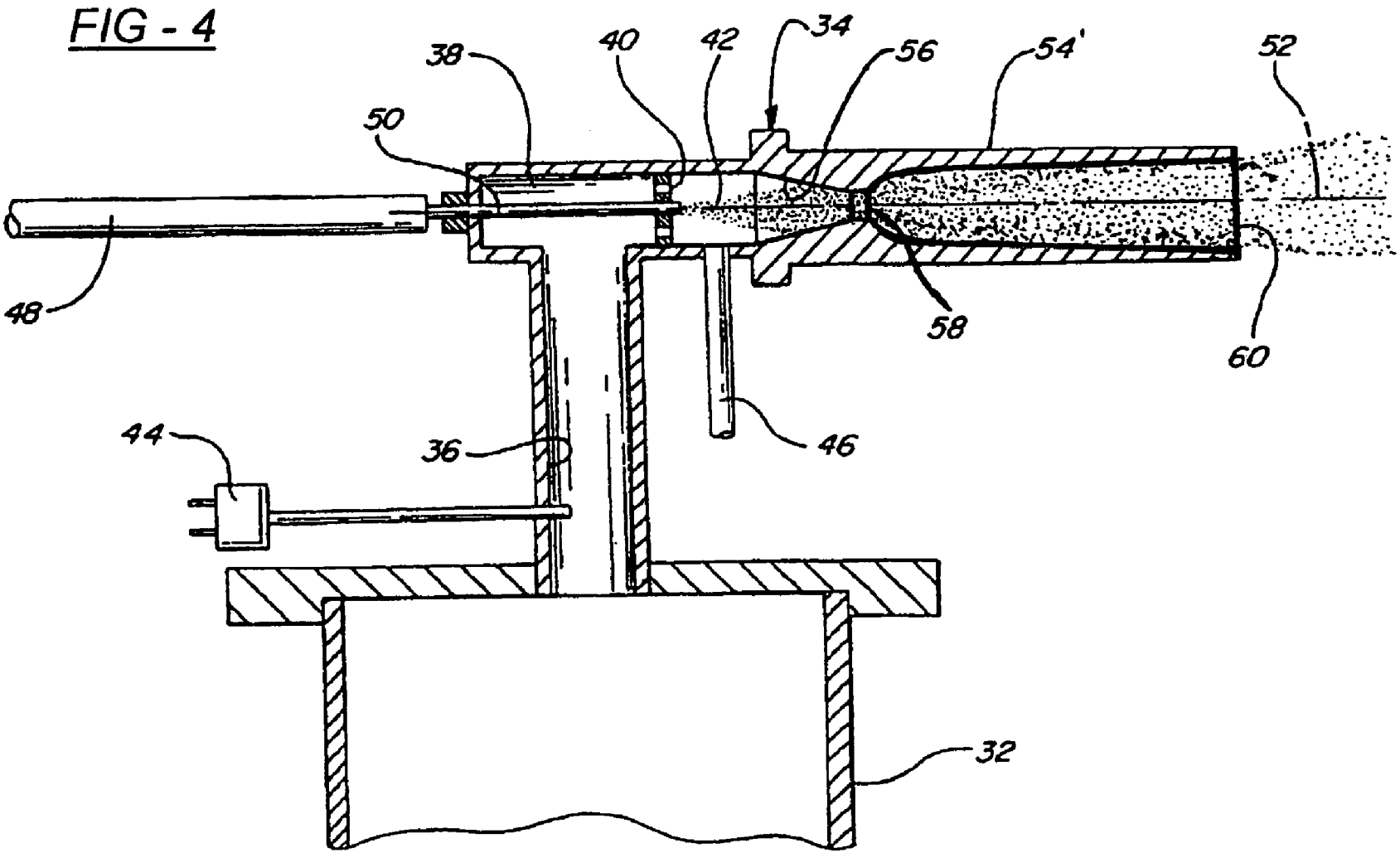
FIG. 4 is an enlarged cross-sectional view of a kinetic spray nozzle of the present invention used with a high pressure powder feeder in the kinetic spray system.
Figure 5:
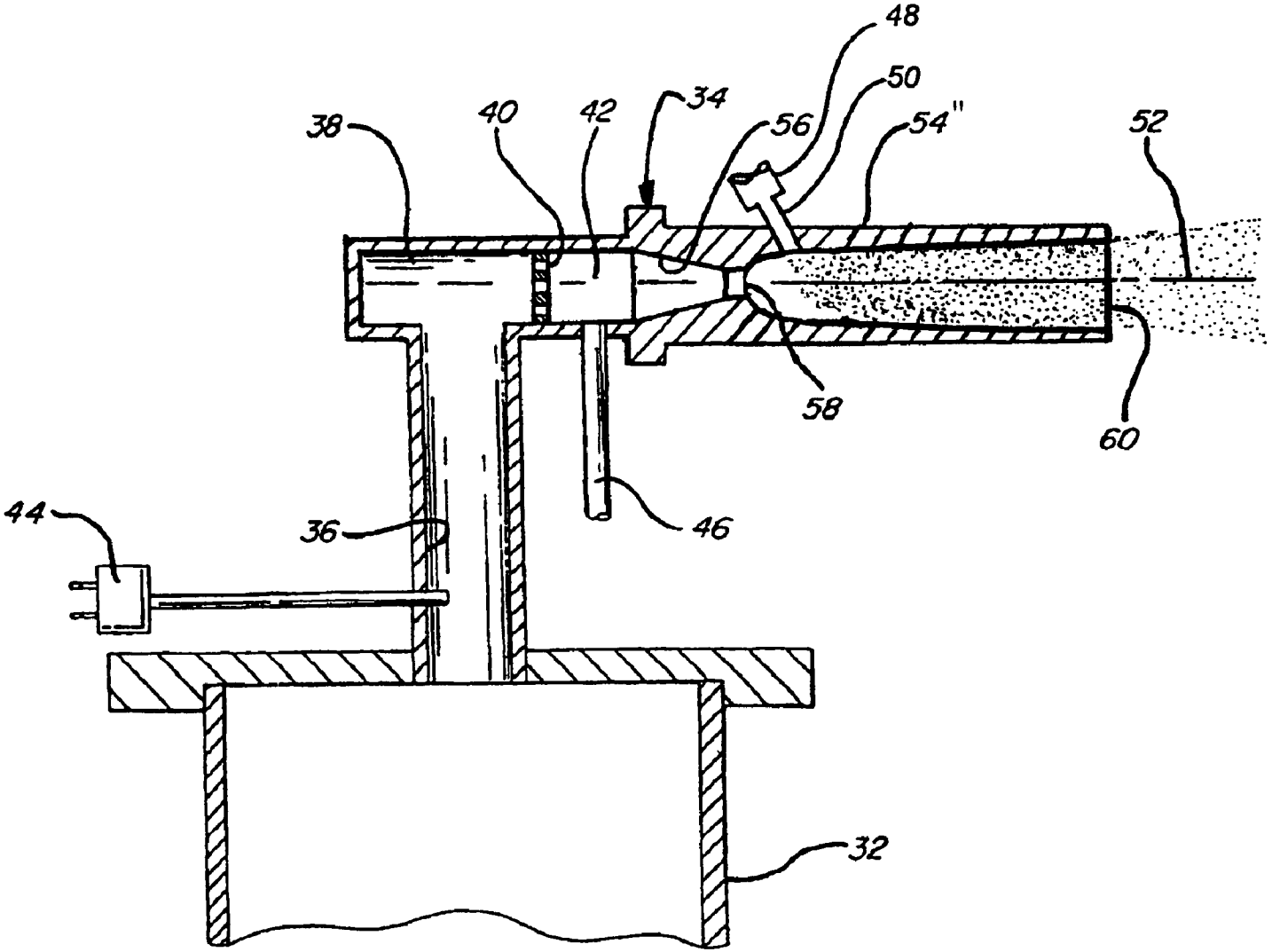
FIG. 5 is an enlarged cross-sectional view of a kinetic spray nozzle of the present invention used with a low pressure powder feeder in the kinetic spray system.

Knowing the gas flow field of a nozzle 54 the particle acceleration within the nozzle 54 can be calculated. As discussed above, the particles within the gas field are accelerated by the drag force of the gas field. The drag force (D) acting on the particles is expressed by the following equation: $D=1/2C_D{}_g(V_g-V_p)^2 A_p$ wherein $V_g$ and $V_p$ are the gas and particle velocity respectively; g is the main gas density; $A_p$ is the projected area of the particle; and $C_D$ is the drag coefficient of the particle, which is a function of the Reynolds number and the Mach number. It can be seen from the equation that the overall particle acceleration potential for the nozzle flow will be proportional to ${}_gV_g{}^2$. It has been found that in most nozzles 54 the particle acceleration potential is highest in the diverging region of the nozzle 54 from just downstream of the throat 58 through approximately the first ⅓ of the diverging region of the nozzle 54. In this portion of the diverging region, the particle acceleration potential increases very rapidly with relatively large values for the gas density. As the gas expands further downstream, the gas density decreases very rapidly as it approaches the exit end 60 of the nozzle 54. Knowing the cross-sectional flow areas of a nozzle 54 it is possible using one-dimensional isentropic flow analysis to calculate the effect of the expansion profile of the diverging region of the nozzle 54 on the particle acceleration. It has been found by the present inventors that rapidly expanding the cross-sectional flow area in the first ⅓ of the diverging region of the nozzle 54 leads to a dramatic increase in the particle velocity achievable using the same main gas temperature. The effect of the rapid expansion of the diverging region immediately following the throat 58 is to cause a rapid decrease in the gas pressure and a corresponding rapid increase in the gas velocity. The rapid increase in the gas velocity is important in achieving rapid acceleration of the particles. FIGS. 4 and 5 show nozzles 54' and 54" designed in accordance with the present invention. FIG. 4 shows a cross-sectional view of a high pressure nozzle 54' designed according to the present invention, while FIG. 5 is of a low pressure nozzle 54" designed according to the present invention.

Figure 6:
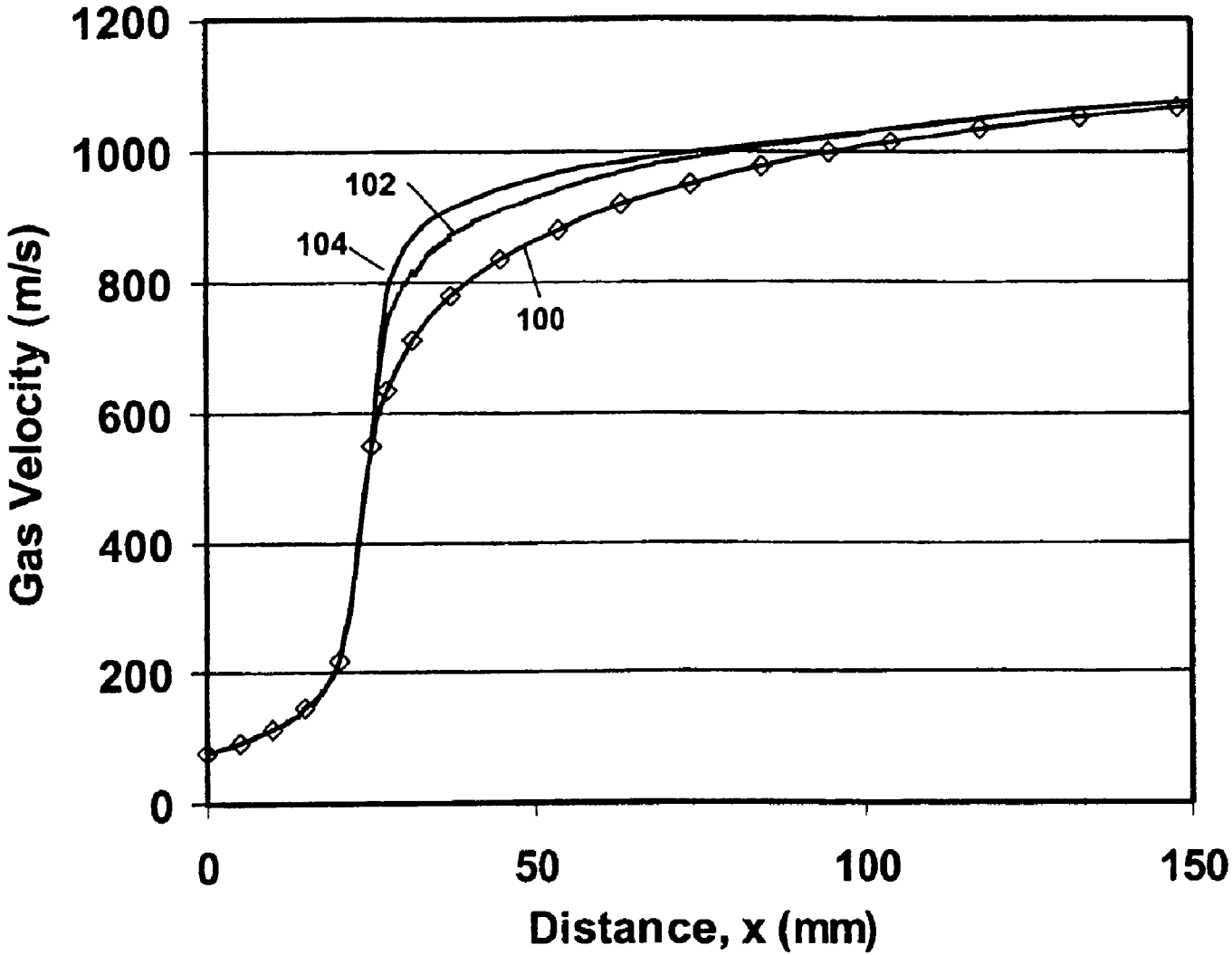
FIG. 6 is a graph showing the gas velocity of a gas through a prior art nozzle and nozzles designed according to the present invention as a function of the distance from the converging end of the nozzle.
Figure 7:
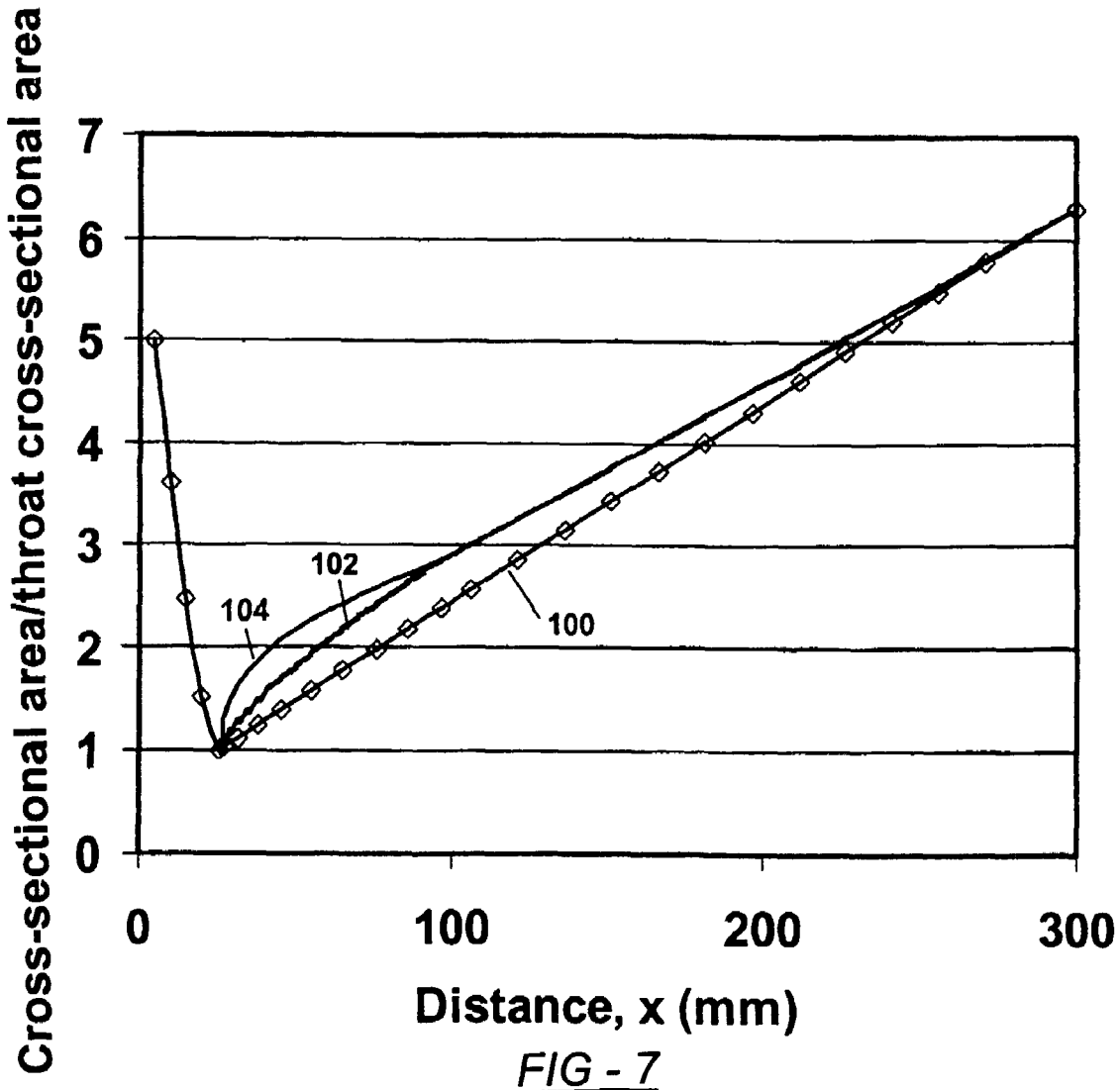
FIG. 7 is a graph showing the cross-sectional area of nozzles normalized to the cross-sectional area of the throat as a function of the distance from the converging end of the nozzle.

The nozzles 54' and 54" shown in FIGS. 4 and 5 are designed according to the present invention and differ from the prior art in that the diverging region just downstream of the throat 58 is rapidly expanded relative to the prior art. The expansion rate gradually decreases to match that of the prior art as shown in FIG. 7. This rapid "bell shaped" expansion preferably occurs within the first one third of the diverging region adjacent the throat 58. The overall shape of the rapid expansion portion can be created using a simple Bezier curve that controls the rapid expansion rate near the throat 58 and the more moderate expansion rate near the end of the first third of the diverging region. Bezier curves are known to those of ordinary skill in the art. The effect of this rapid expansion on the gas velocity was unexpected and is shown in FIG. 6. In FIG. 6, the gas velocity in meters per second is shown on the Y axis and the X axis represents the distance X from the beginning of the converging region of the nozzle 54 out to 160 millimeters. All of the nozzles 54 had a total length of 300 millimeters, the throat 58 located at 25 millimeters from the beginning of the converging region, a throat diameter of 3.4 millimeters, and an exit end 60 having dimensions of 5 millimeters by 12.5 millimeters. The gas velocity profile for a prior art nozzle 54 is shown in trace 100. Two nozzles designed in accordance with the present invention are shown in traces 102 and 104. In these nozzles 54, the expansion rate adjacent the throat 58 was increased to either 1 or 5 millimeters squared per millimeter, 102 and 104 respectively, and then the expansion rate was reduced toward that of the prior art at the end of the first third of the diverging region. It can be seen that the gas velocity increased anywhere from 100 to 160 meters per second relative to that found in the prior art nozzle 54. FIG. 7 shows the normalized cross-sectional areas of the three nozzles 54 as a function of the distance from the converging end of the nozzles shown in FIG. 6, with traces 100, 102, and 104 representing the prior art nozzle, an expansion rate of 1 millimeter squared per millimeter, or an expansion rate of 5 millimeter squared per millimeter, respectively as in FIG. 6. The throat 58 is located at approximately 25 millimeters from the beginning of the converging region and it can be seen that nozzles designed according to the present invention, traces 102 and 104, have a rapid increase n the cross-sectional area immediately following the throat 58 and that this rapid expansion rate gradually decreases toward the standard expansion rate of the diverging region of the prior art nozzle, trace 100. Precise control of the contour of the diverging region in the first one third of the diverging region adjacent the throat 58 can be obtained by using a Bezier curve to control the expansion from the throat 58 to the end of the first one third of the diverging region.

Utilizing nozzles 54' 54" designed according to the present invention it has been found that the deposition efficiency of particles can be increased utilizing the same main gas temperature and pressure relative to the prior art nozzles 54. This has important benefits in manufacturing because it allows one to utilize a lower main gas temperature while still getting efficient coating of a substrate. In practice it has been found that an expansion rate of at least 1 mm per millimeter right at the downstream side of the throat 58 provides a significant benefit to the coating performance of a modified kinetic spray nozzle 54. Preferably, the expansion rate is at least 2 mm per millimeter, more preferably 5 mm per millimeter and most preferably 10 $mm^2$ per millimeter. It is especially beneficial if this rapid expansion rate and the transition to a standard expansion rate occurs in the first third of the diverging region adjacent the throat 58.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

The invention claimed is:

1. A supersonic kinetic spray nozzle comprising:

a converging region and a diverging region separated by a throat, said diverging region extending from said throat to an exit end; and at least a portion of said diverging region adjacent said throat having a cross-sectional expansion rate of at least 1.0 millimeters squared per millimeter;

wherein said portion is located within a first one third of a length of said diverging region adjacent to said throat and wherein said cross-sectional expansion rate decreases between said first one third and said exit end of said diverging region.

2. The nozzle recited in claim 1, wherein said expansion rate is at least 2.5 millimeters squared per millimeter.

3. The nozzle recited in claim 1, wherein said expansion rate is at least 5.0 millimeters squared per millimeter.

4. The nozzle recited in claim 1, wherein said expansion rate is at least 10.0 millimeters squared per millimeter.

5. A kinetic spray system comprising:

a supersonic nozzle having a converging region and a diverging region separated by a throat, said diverging region extending from said throat to an exit end; at least a portion of said diverging region adjacent said throat having a cross-sectional expansion rate of at least 1.0 millimeters squared per millimeter;

said portion is located within a first one third of a length of said diverging region adjacent to said throat and said cross-sectional expansion rate decreases between said first one third and said exit end of said diverging region;

at least one powder injector connected to said nozzle with one of a low pressure or a high pressure powder feeder connected to said injector; and a high pressure source of a heated main gas connected to said nozzle.

6. The kinetic spray system recited in claim 5, wherein said expansion rate is at least 2.5 millimeters squared per millimeter.

7. The kinetic spray system recited in claim 5, wherein said expansion rate is at least 5.0 millimeters squared per millimeter.

8. The kinetic spray system recited in claim 5, wherein said expansion rate is at least 10.0 millimeters squared per millimeter.

9. A method of kinetic spray coating a substrate comprising the steps of:

a) providing particles of a material to be sprayed;

b) providing a supersonic nozzle having a throat located between a converging region and a diverging region, the diverging region extending from the throat to an exit end and at least a portion of the diverging region adjacent the throat having a cross-sectional expansion rate of at least 1.0 millimeters squared per millimeter wherein the portion is located within a first one third of a length of the diverging region adjacent to the throat and wherein the cross-sectional expansion rate decreases between the first one third and the exit end of the diverging region;

c) directing a flow of a gas through the nozzle, the gas having a temperature insufficient to cause melting of the particles in the nozzle; and d) entraining the particles in the flow of the gas and accelerating the particles to a velocity sufficient to result in adherence of the particles on a substrate positioned opposite the nozzle.

10. The method of claim 9, wherein step b) comprises providing a diverging region having at least a portion with a cross-sectional expansion rate of at least 2.5 millimeters squared per millimeter.

11. The method of claim 9, wherein step b) comprises providing a diverging region having at least a portion with a cross-sectional expansion rate of at least 5.0 millimeters squared per millimeter.

12. The method of claim 9, wherein step b) comprises providing a diverging region having at least a portion with a cross-sectional expansion rate of at least 10.0 millimeters squared per millimeter. pg,16

13. The method of claim 9, wherein step a) comprises providing particles having an average nominal diameter of from 60to 250microns.

14. The method of claim 9, wherein step d) comprises accelerating the particles to a velocity of from 300to 1300meters per second.

* * * * *